US008161749B2

(12) United States Patent
Boss et al.

(10) Patent No.: US 8,161,749 B2
(45) Date of Patent: Apr. 24, 2012

(54) COOLED EXHAUST HOOD PLATES FOR REDUCED EXHAUST LOSS

(75) Inventors: Michael J. Boss, Ballston Spa, NY (US); William T. Parry, Rexford, NY (US)

(73) Assignee: General Electric Company, Schenectady, NY (US)

( * ) Notice: Subject to any disclaimer, the term of this patent is extended or adjusted under 35 U.S.C. 154(b) by 661 days.

(21) Appl. No.: 12/419,380

(22) Filed: Apr. 7, 2009

(65) Prior Publication Data

US 2010/0251716 A1 Oct. 7, 2010

(51) Int. Cl.
*F01B 31/16* (2006.01)
*F01D 1/02* (2006.01)

(52) U.S. Cl. ..... 60/686; 60/690; 415/207; 415/211.2

(58) Field of Classification Search ..... 60/685, 60/686, 690–693; 415/207, 208.1, 211.2, 415/221

See application file for complete search history.

(56) References Cited

U.S. PATENT DOCUMENTS

| | | | | |
|---|---|---|---|---|
| 4,013,378 | A | 3/1977 | Herzog | |
| 4,391,564 | A * | 7/1983 | Garkusha et al. | 415/126 |
| 5,167,123 | A | 12/1992 | Brandon | |
| 5,588,799 | A * | 12/1996 | Kreitmeier | 415/211.2 |
| 6,484,503 | B1 | 11/2002 | Raz | |
| 6,971,842 | B2 | 12/2005 | Luniewski et al. | |
| 2007/0081892 | A1 | 4/2007 | Sharrow | |

* cited by examiner

*Primary Examiner* — Hoang M Nguyen

(74) *Attorney, Agent, or Firm* — Ernest G. Cusick; Frank A. Landgraff

(57) ABSTRACT

Cooled exhaust hood plates are provided in areas of high velocity steam flow within an exhaust steam flow of a steam turbine. Coolant is directed within double walled exhaust hood plates to cool plate surfaces adjacent to the high velocity exhaust steam flow. The cooled exhaust hood plates cool and condense the exhaust steam in proximity. Condensation will occur in low velocity area near the exhaust hood plate to reduce the boundary layer and improve the flow through the hood, improving overall turbine performance.

20 Claims, 4 Drawing Sheets

COOLED EXHAUST HOOD PLATES FOR REDUCED EXHAUST LOSS

BACKGROUND OF THE INVENTION

The invention relates generally to steam turbines and more specifically to exhaust hoods for steam turbines.

In the discharge of exhaust steam from an axial flow turbine, for example discharge of this exhaust steam to a condenser, it is desirable to provide as smooth a flow of steam as possible and to minimize energy losses from accumulation of vortices and turbulences and non-uniformity in such flow. Usually the exhaust from the turbine is directed into an exhaust hood and from there to through a discharge opening in the hood in a direction essentially normal to the axis of the turbine into a condenser. It is desirable to achieve a smooth transition from axial flow at the exhaust of the turbine to radial flow in the exhaust hood and thence a smooth flow at the discharge opening of this hood into the condenser.

In the constructing of an effective exhaust hood for use with such an axial flow turbine it is desirable to avoid acceleration losses within any guide means employed therein and to achieve a substantially uniform flow distribution at the discharge opening of the exhaust hood for the most efficient conversion of energy in the turbine and effective supplying of exhaust steam to the condenser to which it is connected.

It is also desirable to achieve optimum efficiency at the last stage buckets of the turbine prior to exhaust from the turbine by achieving a substantially uniform circumferential and radial pressure distribution in the exit plane of the last stage buckets. Finally, it is desirable to accomplish these results while employing a hood having as short an axial length as possible.

Prior art has employed, in the exhaust hood of the steam turbine, vanes having smoothly curved surfaces for changing the axial flow of the steam from the turbine to the generally radial flow. For example of such an arrangement for converting the axial flow of the exhaust from the turbine to radial flow is shown in U.S. Pat. No. 3,552,877 by Christ et al. Further developments in prior art exhaust hoods for axial flow turbines, such as U.S. Pat. No. 4,013,378 by Herzog, have incorporated multiple sets of vanes for further smoothing flow.

Such arrangements, however have not fully provided for effectively directing of the exhaust steam to the discharge opening of an exhaust hood with reduced acceleration losses and reduced losses resulting from the forming of energy-consuming vortices in the flow of the exhaust steam. Moreover, they have not fully achieved substantially uniform circumferential and radial pressure distribution at the exit plane of the last stage turbine buckets, a consideration which is of increasing importance for buckets having high tip speeds and high exit Mach numbers.

Diffusers are commonly employed in steam turbines. Effective diffusers can improve turbine efficiency and output. Unfortunately, the complicated flow patterns existing in such turbines as well as the design problems caused by space limitations make fully effective diffusers almost impossible to design. A frequent result is flow separation that fully or partially destroys the ability of the diffuser to raise the static pressure as the steam velocity is reduced by increasing the flow area. This is often caused by a vapor boundary layer that gets thicker along the diffuser surface in the direction of flow ultimately permitting the flow separation mentioned above.

U.S. Pat. No. 5,167,123 by Ronald E. Brandon describes a method and apparatus for improving the performance of vapor turbine diffusers by preventing flow separation from the diffuser walls. Such separation from the diffuser walls is decreased or eliminated herein by chilling the diffuser walls below the saturation temperature; causing some condensation to occur and insuring vapor flow toward the walls to eliminate the natural tendency toward separation in diffusing vapor passages.

Although using flow vanes may smooth the flow of steam from the last stage of the turbine to the condenser and the cooling of the diffuser walls may improve the performance of vapor turbine diffusers by preventing flow separation from the diffuser walls, other high velocity steam flow areas remain the exhaust hood. Accordingly, it may be desirable to provide further measures to reduce areas of high flow velocity within the exhaust hood.

BRIEF DESCRIPTION OF THE INVENTION

The present invention relates to slowing the velocity of saturated steam flow within the exhaust path between a steam turbine and a condenser, thereby reducing exhaust losses. One or more cooled exhaust hood plates may be provided within the exhaust flow path in areas of high velocity flow to condense the saturated steam.

Briefly in accordance with one aspect, an exhaust system is provided for a steam turbine. The exhaust system includes an exhaust hood coupled to a casing of a steam turbine and a diffuser within the exhaust hood, adapted for receiving an exhaust steam flow from an exhaust outlet of the casing of the steam turbine and discharging the exhaust steam flow. A condenser is adapted for receiving the exhaust steam flow from the exhaust hood. The exhaust steam flow is directed from an outlet of the diffuser to the condenser. At least one exhaust hood plate within the exhaust hood is adapted for providing a substantially uniform distribution of the exhaust steam. A cooling flow is provided within the at least one exhaust hood plate is adapted for condensing the exhaust steam in proximity to the structural elements.

According to a second aspect of the present invention, a method is provided for reducing exhaust loss in an exhaust hood of a steam turbine, which includes a diffuser and an exhaust path from an outlet of the diffuser to a condenser. The method includes mapping an exhaust steam flow between a steam outlet of a final stage of a steam turbine and a condenser and then determining high velocity regions of exhaust steam flow. At least one guide vane is positioned within the exhaust steam flow and the at least one guide vane is cooled. Exhaust steam flow in proximity to the guide vane is cooled and condensed.

According to a further aspect of the present invention, a steam turbine is provided including an exhaust system with an exhaust hood coupled to a casing of the steam turbine and a diffuser within the exhaust hood, adapted for receiving an exhaust steam flow from an exhaust outlet of the casing of the steam turbine and discharging the exhaust steam flow. A condenser is provided, adapted for receiving the exhaust steam flow from the exhaust hood. The exhaust steam flow is directed from an outlet of the diffuser to the condenser. At least one exhaust hood plate is provided within the exhaust hood, adapted for delivering a substantially uniform distribution of the exhaust steam. A cooling flow is directed internal to the at least one exhaust hood plate, adapted for condensing the proximate exhaust steam.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including reducing areas of high velocity in an exhaust steam flow from a steam turbine, thereby reducing exhaust flow losses.

The current technology for steam turbine exhaust hoods, is primarily a fabricated steel structure, which supports the stationary and rotating pieces of the turbine, and seals the exhaust area from atmospheric air. The exhaust of the steam turbine is at a high vacuum, i.e. well below atmospheric pressure. Therefore the exhaust hood structure must be stiff enough to withstand the pressure force of atmospheric air, and yet large enough to allow the steam to expand and diffuse thorough it. The present invention provides exhaust hood plates within the exhaust steam flow, which have coolant circulating through them. The cooled plates condense the steam near the plates, and improve the flow through the exhaust hood with this action of condensation. The exhaust hood plates may be structural members within the exhaust hood, designed to promote the integrity of the exhaust hood structure. The exhaust hood plates may also act as flow vanes or flow guides arranged to assist in smoothly directing the flow of exhaust steam from the turbine and through the exhaust hood to a condenser connected thereto.

Figure 1:
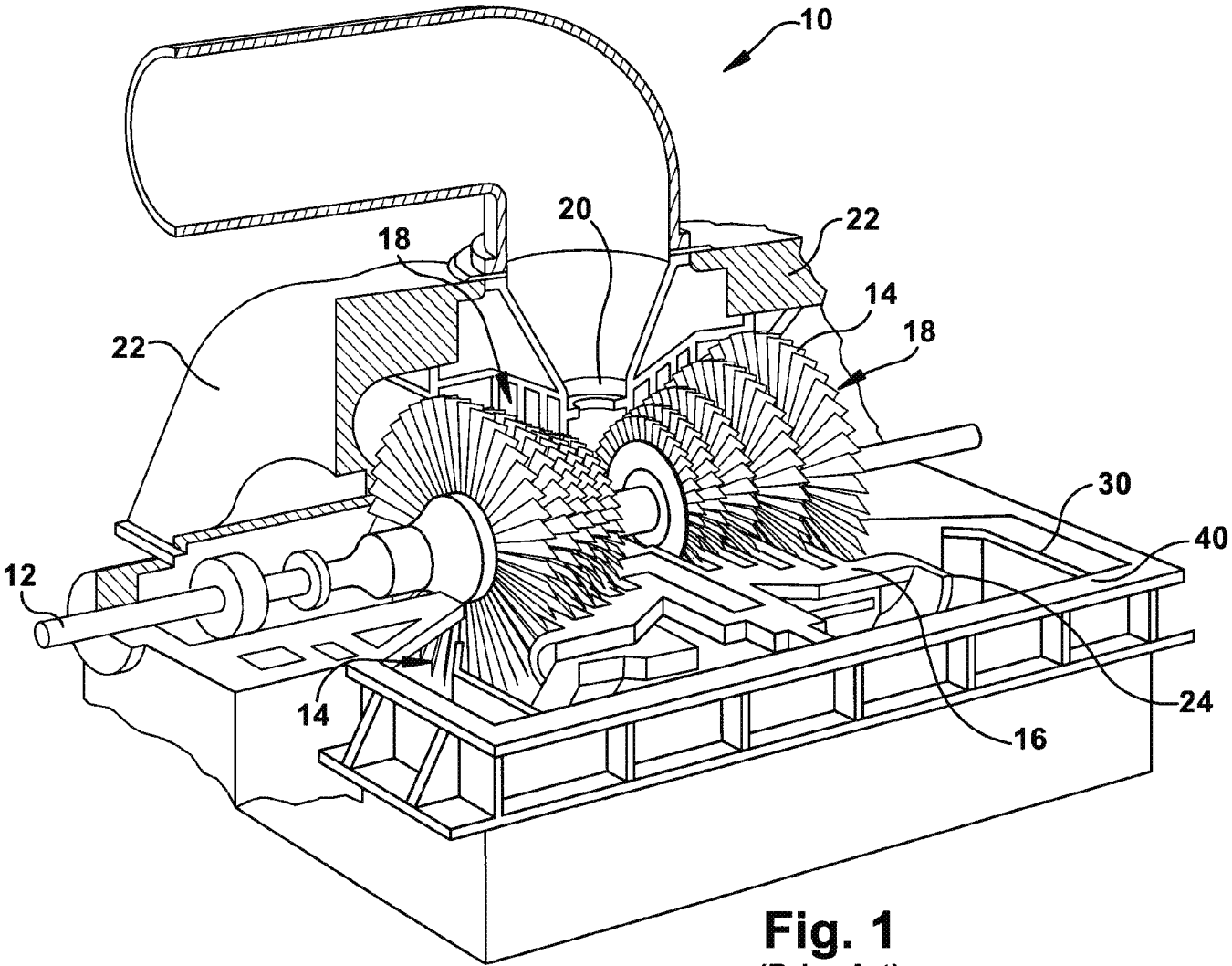
Fig. 1 (Prior Art)
FIG. 1 illustrates a perspective partial cutaway of a steam turbine.
Figure 2:
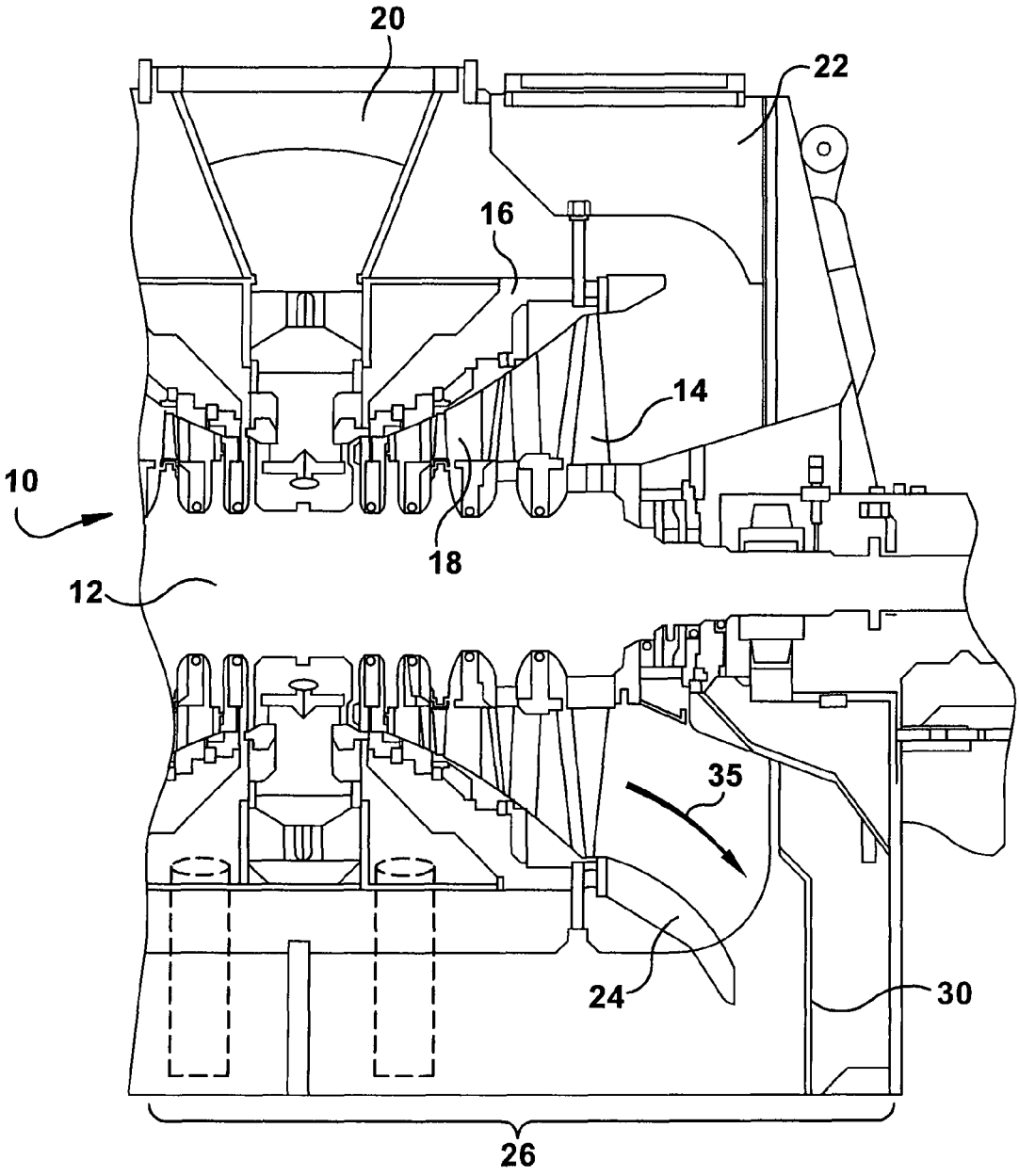
Fig. 2 (Prior Art)
FIG. 2 illustrates a portion of a steam turbine including an exhaust flow path.

Exhaust hood loss can have a very large impact on the steam turbine performance. The exhaust hood may be designed to diffuse the steam leaving the last stage, then this exhaust hood loss can be reduced. By having coolant circulating through the exhaust hood plates in the flow path the steam adjacent to the cooled plates will be cooled and will condense on the cooled plates. This condensation will occur in the low velocity flow region near the plates, and it will reduce the boundary layer, and improve the flow through the hood. This act of condensation will also assist in keeping the exhaust steam flow attached to the hood, and resist flow separation FIG. 1 illustrates a perspective partial cutaway of a steam turbine a portion of a steam turbine. FIG. 2 illustrates a portion of a steam turbine including an exhaust flow path. The steam turbine, generally designated 10, includes a rotor 12 mounting a plurality of turbine buckets 14. An inner casing 16 is also illustrated mounting a plurality of diaphragms 18. A centrally disposed generally radial steam inlet 20 applies steam to each of the turbine buckets and stator blades on opposite axial sides of the turbine to drive the rotor. The stator vanes of the diaphragms 18 and the axially adjacent buckets 14 form the various stages of the turbine forming a flow path and it will be appreciated that the steam is exhausted from the final stage of the turbine for flow into a condenser not shown.

Also illustrated is an outer exhaust hood 22, which surrounds and supports the inner casing of the turbine as well as other parts such as the bearings. The turbine includes steam guides 24 for guiding the steam exhausting from the turbine into an outlet 26 for flow to one or more condensers. With the use of an exhaust hood supporting the turbine, bearings and ancillary parts, the exhaust steam path is tortuous and subject to pressure losses with consequent reduction in performance and efficiency. A plurality of support structures may be provided within the exhaust hood 22 to brace the exhaust hood and to assist in guiding the steam exhaust flow. An exemplary support structure 30 is situated to receive and direct the steam exhaust flow 35 from the steam turbine 10. The support structure 30 will be described in greater detail in FIG. 4.

Figure 3:
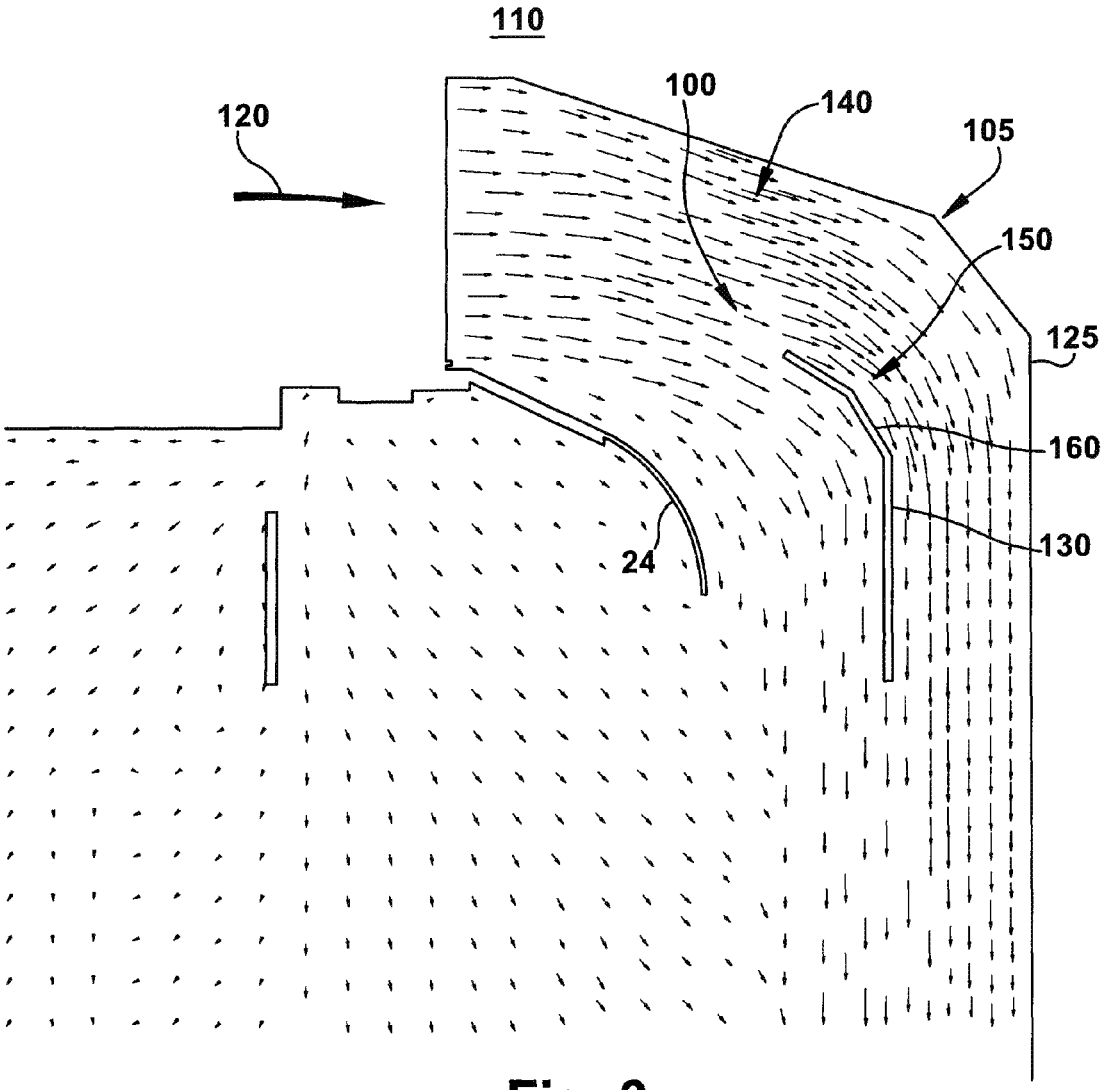
FIG. 3 illustrates an exemplary exhaust steam flow pattern in a lower half of an exhaust hood of a steam turbine.

FIG. 3 illustrates an exemplary steam exhaust flow pattern 100 for a steam turbine exiting through the lower half 105 of an exhaust hood 110. Steam exhaust flow 120 from the turbine is directed downward by the hood outer shell 125 and a structural member (exhaust hood plate) 130. The arrows 140 of the steam exhaust flow pattern represents velocity profiles of the steam exhaust flow 120. The velocity profiles may be obtained through analysis techniques or by flow measurement. Velocity within the flowpath is represented by a density of arrows wherein a higher density of arrows represents a higher flow velocity. The region of highest velocity 150 in the field is shown by the density of arrows to be adjacent to surface 160 of the structural member 130. Analysis or measurement may further predict low velocity steam layer adjacent to surface 160, which may choke off flow and force higher velocity through the remaining space.

In an embodiment of the present invention exhaust hood plates within such regions of high velocity may be cooled. In this exemplary figure, it may be desirable to cool surface 160 to condense the steam, reducing the boundary layer and improving flow through the exhaust hood. Other exhaust hood plates within the steam flow path may also be cooled.

Figure 4:
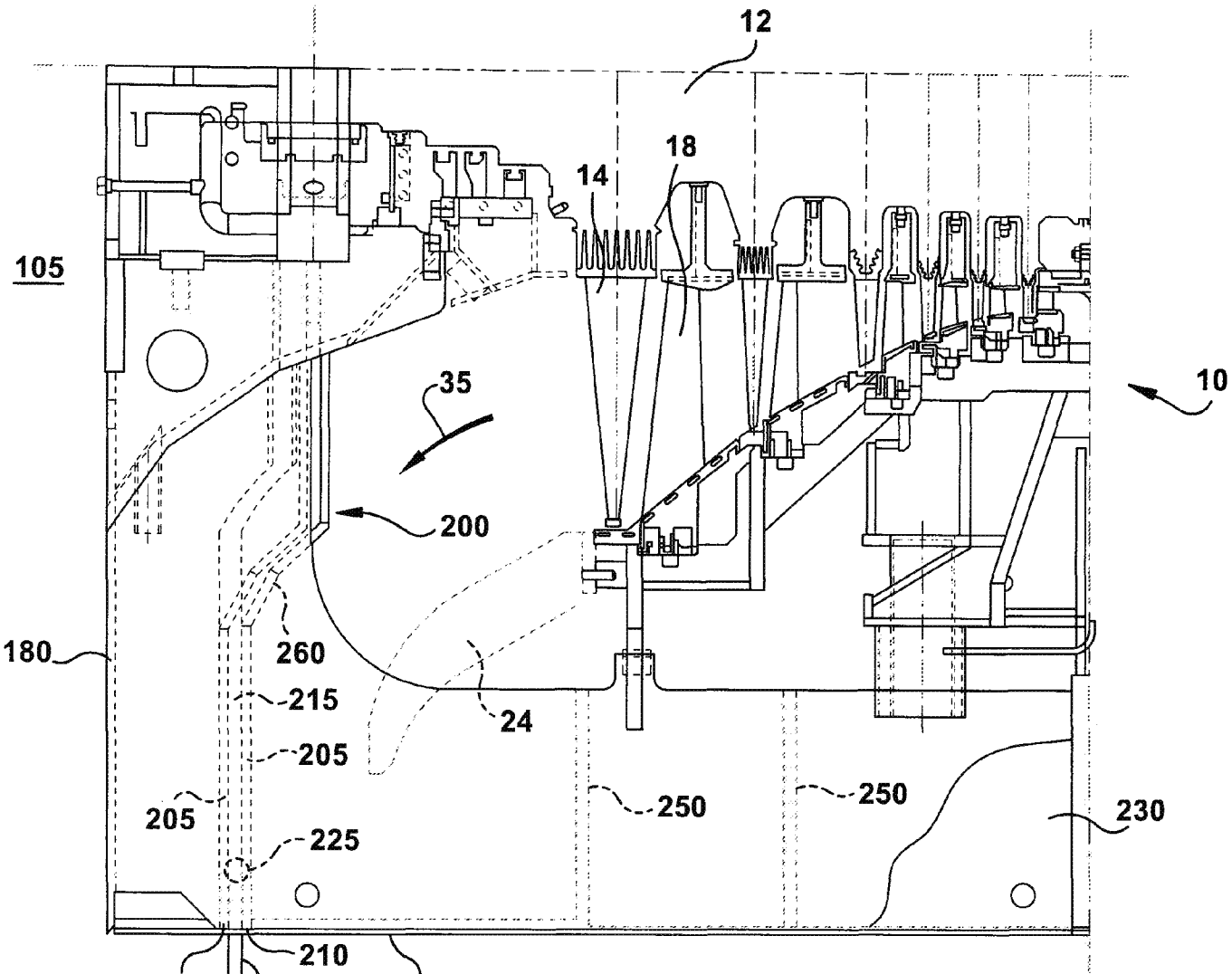
FIG. 4 illustrates an exemplary exhaust hood plate arranged for cooling steam flow in the lower half of an exhaust hood.

FIG. 4 illustrates an embodiment for an exhaust hood plate 200 adapted for cooling steam flow in the lower exhaust hood 105. The lower exhaust hood 105 may be bounded by sides 230 (one shown) and by end structure 180. The exhaust hood plate 200, as shown, may be a structural member. The structural member may extend typically in a generally vertical plane from a side frame (FIG. 1, 40) of the lower exhaust hood towards the rotor 12. A bottom part 210 of the structural member 200 may be mounted on the base 170 of the lower exhaust hood 105. The structural member 200 may further mate with support struts (not shown) extending from the side frame of the exhaust shell to an end frame of the exhaust hood and extending upward from a base of the exhaust hood. Other structural members 250 may be situated in the lower exhaust hood, however, these structures may not be in areas of high exhaust steam flow and therefore not be in need of cooling for exhaust steam flow enhancement.

The exhaust hood plates 200 may further act as exhaust flow guides that assist in directing exhaust flow from an initial axial direction to a radial direction within the exhaust hood. These exhaust hood plates may exist both in the upper half and lower half of the exhaust hood. However analysis of flow velocity in the respective upper and lower halves of the exhaust hood may indicate higher exhaust steam velocities in the lower half exhaust hood, making the application of cooling to structures of the lower half more economically desirable.

The exhaust hood plates 200 arranged for cooling may include double walled structural plates 205 forming an internal channel 215 between the structural plates for a flow of a coolant. Internal baffles between the structural plates 205 may further direct the flow of the coolant. Coolant may be specifically directed to cool specific surfaces 260 of the structural plates so as to condense along the surface. By decreasing the volume of the steam adjacent to the surface through cooling, more space may be made available for the remaining exhaust steam to pass, thereby reducing the high steam velocity areas around the surface of the structural plates. The condensation of exhaust hood steam will reduce the required area for diffusing. Local condensation in boundary layer of steam flow will reduce boundary layer. Local condensation in boundary layer of steam flow will also reduce flow separation.

A cooling system may provide coolant from a side surface 230 the lower exhaust hood 105 through an inlet port 225 to the channel 215 between plates 205. Cooling ports may be provided on opposing sides of the lower exhaust hood 105.

The cooling system may discharge the coolant from a discharge port 235 at a convenient location, which may include the bottom 170 of the lower exhaust hood. The coolant may include cooled condensate, chilled water or a non-water coolant. The cooling system may further include inlet valves, outlet valves, flow instruments and other known fluid components.

The exhaust hood plates with cooling may be provided on future steam turbine exhaust hoods or be retrofit to existing steam turbine exhaust hoods. Retrofit on existing steam turbine exhaust hoods may be especially desirable for upgraded steam turbines wherein the higher rating of the upgraded unit would result in higher exhaust steam exhaust velocity impinging on the exhaust hood plates and potentially higher pressure drops and efficiency losses without the condensing effects of the present invention.

While various embodiments are described herein, it will be appreciated from the specification that various combinations of elements, variations or improvements therein may be made, and are within the scope of the invention.

The invention claimed is:

1. An exhaust system for a steam turbine, comprising:
an exhaust hood coupled to a casing of a steam turbine;
a diffuser within the exhaust hood, adapted for receiving an exhaust steam flow from an exhaust outlet of the casing of the steam turbine and discharging the exhaust steam flow;
a condenser adapted for receiving the exhaust steam flow from the exhaust hood;
an exhaust steam flow from an outlet of the diffuser to the condenser;
at least one exhaust hood plate adapted for providing a substantially uniform distribution of the exhaust steam flow; and
a coolant flow within the exhaust hood plate adapted for condensing proximate exhaust steam flow.

2. The exhaust system according to claim 1, wherein the at least one exhaust hood plate is provided in the exhaust steam flow within the diffuser.

3. The exhaust system according to claim 1, wherein the at least one exhaust hood plate is provided in the exhaust steam flow between the outlet of the diffuser and the condenser.

4. The exhaust system according to claim 1, wherein the at least one exhaust hood plate directs the exhaust steam flow from an axial flow to a radial flow.

5. The exhaust system according to claim 1, according to claim 1, wherein the structural elements comprise:
double walled structural plates; and
internal baffles adapted to direct the coolant flow to specific parts of the plate for cooling and condensation of the exhaust steam.

6. The exhaust system according to claim 5, wherein the coolant flow comprises: condensate from the condenser.

7. The exhaust system according to claim 5, wherein the coolant flow comprises: a chilled coolant.

8. The exhaust system according to claim 5, wherein the coolant flow comprises: a non-water coolant.

9. A method for providing a reduced exhaust loss in an exhaust hood of a steam turbine which includes a diffuser and an exhaust path from an outlet of the diffuser to a condenser, the method comprising:
mapping exhaust steam flow between a steam outlet of a final stage of a steam turbine and a condenser;
determining high velocity regions of exhaust steam flow;
locating at least one exhaust hood plate within the exhaust steam flow;
cooling a surface of the at least one exhaust hood plate with an internal coolant flow;
cooling the exhaust steam flow in proximity to the surface of the at least one exhaust hood plate; and
condensing the exhaust steam flow in proximity to the structural elements.

10. The method according to claim 9, the step of locating the at least one exhaust hood plate within the exhaust steam flow comprising:
locating the at least one structural element along a high velocity region of the exhaust steam flow.

11. The method according to claim 10, the step of locating the at least one exhaust hood plate further comprising:
forming the at least one exhaust hood plate to direct flow from an axial direction to a radial direction within the exhaust hood.

12. The method according to claim 11, further comprising: locating at least one exhaust hood plate within the diffuser.

13. The method according to claim 11, further comprising: locating the at least one exhaust hood plate between the diffuser and the condenser.

14. The method according to claim 11, the step of cooling the exhaust hood plate comprising:
providing a double-walled outer structure for the structural elements including internal baffling;
supplying a coolant flow to the double-walled outer structure; and
directing the coolant flow through the internal baffling to a surface of the exhaust hood plate to be cooled.

15. The method according to claim 14, wherein the coolant flow comprises a chilled coolant.

16. The method according to claim 14, wherein the coolant flow comprises condensate from the condenser.

17. The method according to claim 14, wherein the coolant flow comprises a non-water coolant.

18. A steam turbine, comprising:
an exhaust system with an exhaust hood coupled to a casing of the steam turbine;
a diffuser within the exhaust hood, adapted for receiving an exhaust steam flow from an exhaust outlet of the casing of the steam turbine and discharging the exhaust steam flow;
a condenser adapted for receiving the exhaust steam flow from the exhaust hood;
an exhaust steam flow from an outlet of the diffuser to the condenser;
at least one exhaust hood plate within the exhaust hood, adapted for providing a substantially uniform distribution of the exhaust steam flow; and
a coolant flow within the at least one exhaust hood plate, adapted for condensing the proximate exhaust steam flow.

19. The exhaust system according to claim 18, wherein the structural elements are provided in at least one of the exhaust steam flow within the diffuser and the exhaust steam flow between the outlet of the diffuser and the condenser.

20. The exhaust system according to claim 1, according to claim 1, wherein the structural elements comprise:
double walled structural plates; and
internal baffles adapted to direct the coolant flow to a cooling surface of the at least one exhaust hood plate.

* * * * *

UNITED STATES PATENT AND TRADEMARK OFFICE

CERTIFICATE OF CORRECTION

PATENT NO. : 8,161,749 B2
APPLICATION NO. : 12/419380
DATED : April 24, 2012
INVENTOR(S) : Boss et al.

It is certified that error appears in the above-identified patent and that said Letters Patent is hereby corrected as shown below:

In Column 2, Line 59, delete "DRAWING" and insert -- DRAWINGS --, therefor.

In Column 2, Line 67, delete "turbine." and insert -- turbine; --, therefor.

In Column 3, Line 30, delete "guides" and insert -- guides, --, therefor.

In Column 3, Line 37, delete "path" and insert -- path, --, therefor.

In Column 4, Line 18, delete "invention" and insert -- invention, --, therefor.

In Column 5, Line 33, in Claim 1, delete "plate" and insert -- plate, --, therefor.

In Column 5, Lines 47-48, in Claim 5, delete "according to claim 1, according to claim 1," and insert -- according to claim 1, --, therefor.

In Column 6, Line 24, in Claim 14, delete "claim 11," and insert -- claim 10, --, therefor.

Signed and Sealed this
Eighteenth Day of September, 2012

David J. Kappos

David J. Kappos
*Director of the United States Patent and Trademark Office*